US008992390B2

(12) United States Patent
Chen et al.

(10) Patent No.: US 8,992,390 B2
(45) Date of Patent: Mar. 31, 2015

(54) METHOD OF TAKING SLIDING EXERCISE

(75) Inventors: Larry Chen, Taichung (TW); Kuo-Chen Lin, Taichung (TW)

(73) Assignee: Ucheer Health Tech Co., Ltd., Taichung (TW)

( * ) Notice: Subject to any disclaimer, the term of this patent is extended or adjusted under 35 U.S.C. 154(b) by 34 days.

(21) Appl. No.: 13/588,273

(22) Filed: Aug. 17, 2012

(65) Prior Publication Data

US 2014/0051551 A1 Feb. 20, 2014

(51) Int. Cl.

| | |
|---|---|
| ***A63B 22/00*** | (2006.01) |
| ***A63B 71/00*** | (2006.01) |
| ***A63B 21/068*** | (2006.01) |
| ***A63B 23/02*** | (2006.01) |
| *A63B 69/00* | (2006.01) |

(52) U.S. Cl.

CPC ..... *A63B 21/068* (2013.01); *A63B 22/0069* (2013.01); *A63B 23/0216* (2013.01); *A63B 69/0022* (2013.01); *A63B 69/0057* (2013.01); *A63B 2022/0038* (2013.01); *A63B 2208/0204* (2013.01)

USPC ..... 482/51; 482/70; 482/80

(58) Field of Classification Search

CPC .... A63B 71/00; A63B 23/04; A63B 23/0423; A63B 23/0488; A63B 69/18

USPC ..... 482/51, 70, 71, 73, 79, 80, 146, 147, 482/907

See application file for complete search history.

(56) References Cited

U.S. PATENT DOCUMENTS

| | | | | |
|---|---|---|---|---|
| 4,340,214 | A * | 7/1982 | Schutzer | 482/51 |
| 5,833,584 | A * | 11/1998 | Piaget et al. | 482/70 |
| 7,014,595 | B2 * | 3/2006 | Bruno | 482/51 |
| 7,115,073 | B2 * | 10/2006 | Nizamuddin | 482/51 |
| 7,238,146 | B1 * | 7/2007 | Chen | 482/52 |
| 7,556,592 | B2 * | 7/2009 | Nizam | 482/70 |
| 7,780,577 | B2 * | 8/2010 | Arnold | 482/51 |
| 7,874,963 | B2 * | 1/2011 | Grind | 482/71 |
| 7,931,568 | B1 * | 4/2011 | Lin | 482/70 |
| 7,959,544 | B2 * | 6/2011 | Palmer | 482/130 |
| 7,981,005 | B1 * | 7/2011 | Tsai | 482/51 |
| 8,057,362 | B2 * | 11/2011 | Nadim | 482/51 |
| 8,167,778 | B2 * | 5/2012 | Lai | 482/51 |
| 8,409,058 | B2 * | 4/2013 | Gordon et al. | 482/52 |
| 2003/0144115 | A1 * | 7/2003 | Duvernay et al. | 482/79 |
| 2005/0164849 | A1 * | 7/2005 | Saikawa | 482/92 |
| 2007/0202994 | A1 * | 8/2007 | Alessandri et al. | 482/51 |
| 2011/0166004 | A1 * | 7/2011 | Splane | 482/131 |
| 2012/0231933 | A1 * | 9/2012 | Chen | 482/52 |

* cited by examiner

*Primary Examiner* — Loan H Thanh
*Assistant Examiner* — Nyca T Nguyen
(74) *Attorney, Agent, or Firm* — Ming Chow; Sinorica, LLC

(57) ABSTRACT

A method of taking a sliding exercise, which is taken on a training machine and the training machine has two pedals, includes the steps of: a) putting feet on the pedals; and b) reciprocating the feet in opposite directions or in the same direction. The feet respectively move in a curved path on a substantial horizontal plane. Therefore, the use's feet reciprocate forward/rearward and split to train user's muscles.

13 Claims, 7 Drawing Sheets

METHOD OF TAKING SLIDING EXERCISE

BACKGROUND OF THE INVENTION

1. Field of the Invention

The present invention relates generally to fitness and exercise, and more particularly to a method of taking sliding exercise on a training machine.

2. Description of the Related Art

People usually exercise on various training machines for train his/her muscle or for fitness. The conventional training machines make users to move in a specific path, such as the stepper makes users to step repeatedly, the elliptical trainer makes users to move his/her feet in an elliptical path, which is like the path of feet when he/she is walking or running, the airwalker makes users to move his/her feet forward and rearward in a curved path, and a trainer makes users to split. These training machines may be operated indoor to make users to feel like he/she is exercising outdoors so that these machines are very popular. A variety of new training machines are provided in the market.

The specified path of movement only train specified muscles so that a new path of exercise must be provided in a modern training machine.

SUMMARY OF THE INVENTION

The primary objective of the present invention is to provide a method of taking sliding exercise in a new path.

The secondary objective of the present invention is to provide a method of taking a sliding exercise, wherein the sliding exercise is taken on a training machine and the training machine has two pedals. The method includes the steps of: a) putting feet on the pedals; and b) reciprocating the feet in opposite directions or in the same direction. The feet respectively move in a curved path on a substantial horizontal plane.

Therefore, the use's feet reciprocate forward/rearward and split to train user's muscles.

DETAILED DESCRIPTION OF THE INVENTION

The purpose of the present invention is to provide a new path of a sliding exercise for training. Both feet of a user slide on a substantial horizontal plane. It is preferable that the sliding exercise is taken on a specific training machine, and the training machine has two pedals to move in the new path.

Figure 1:
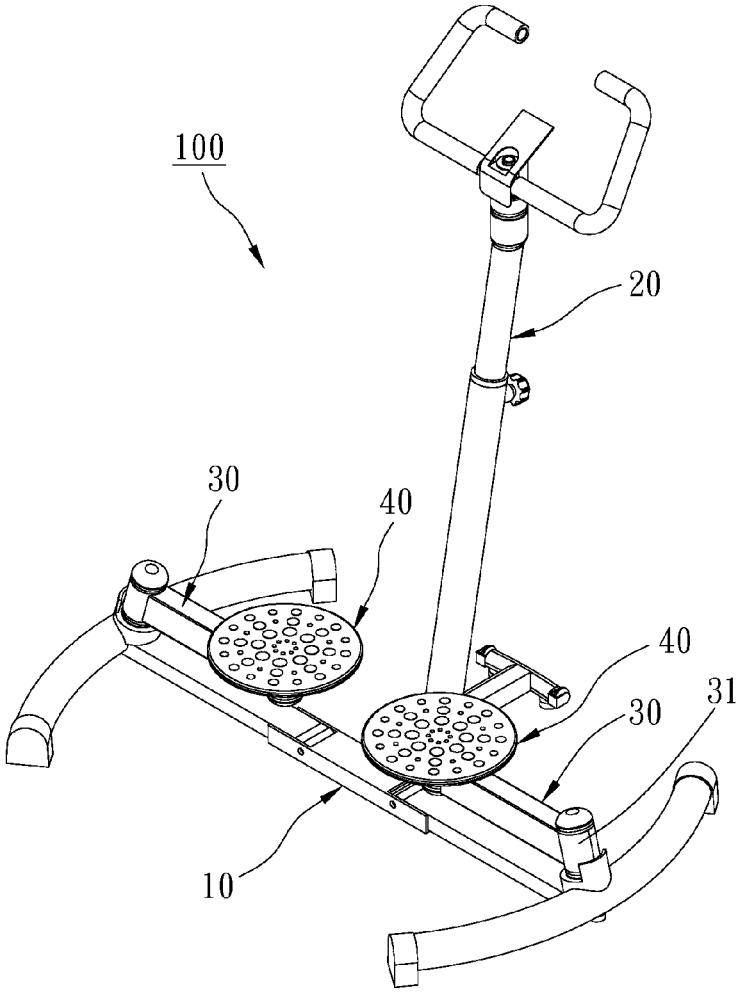
FIG. 1 is a perspective view of the training machine of a preferred embodiment of the present invention.
Figure 2:
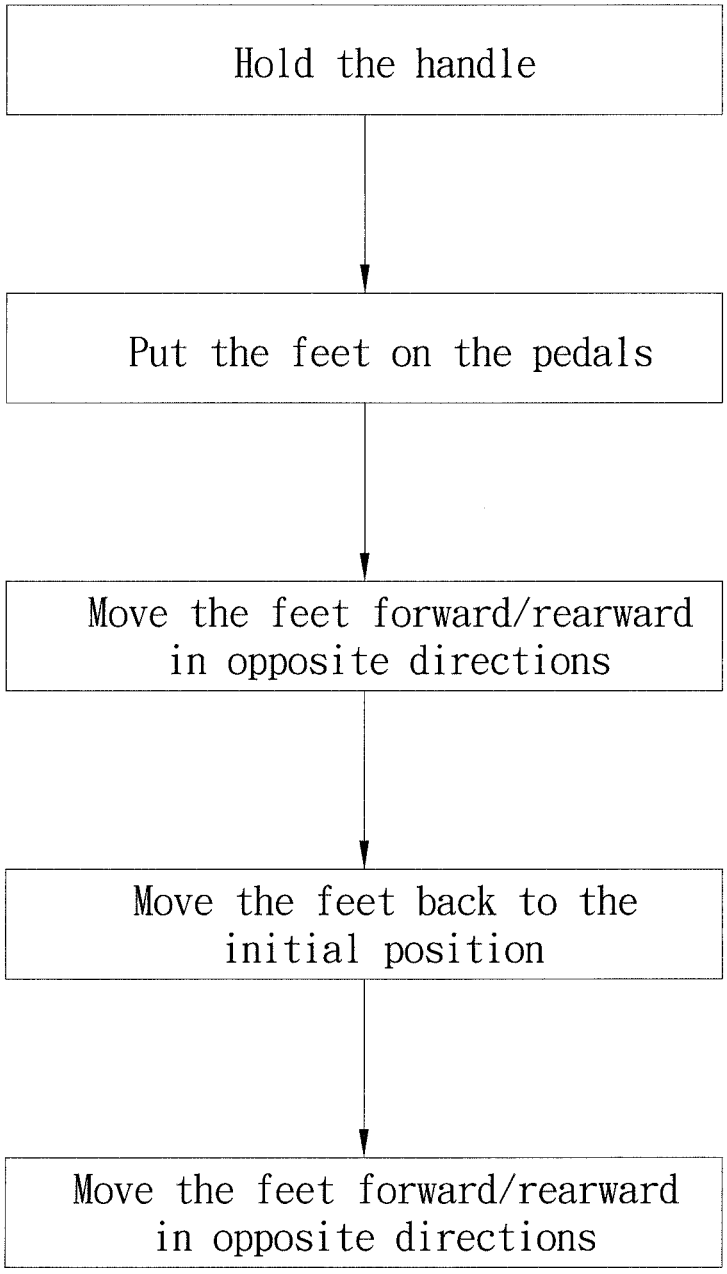
FIG. 2 is a flow chart of the preferred embodiment of the present invention.
Figure 3:
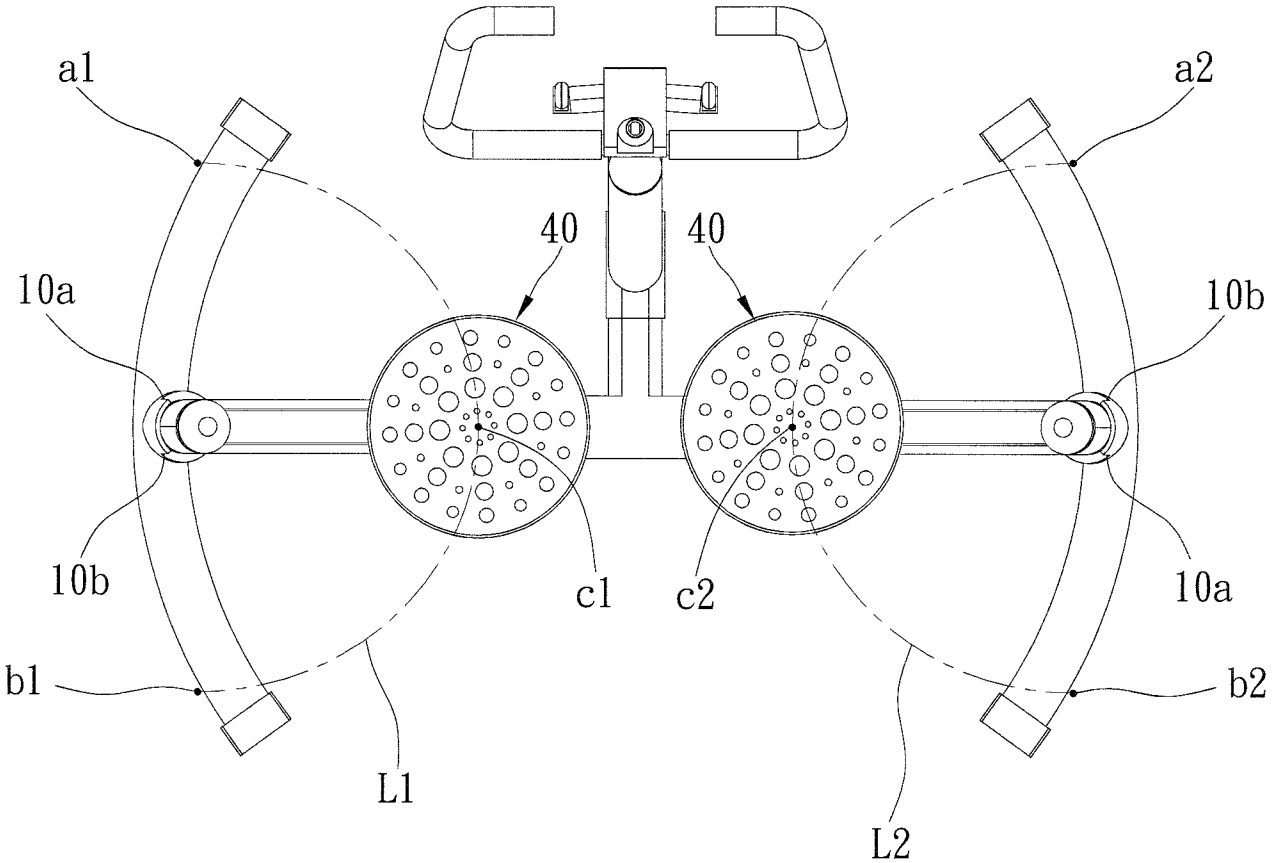
FIG. 3 is a top view of the training machine of the preferred embodiment of the present invention, showing the path of motion in the horizontal plane.

As shown in FIG. 1 and FIG. 2, a training machine 100 for the sliding exercise the preferred embodiment of the present invention includes a frame 10, a handle 20, two rotary members 30, and two pedals 40. The frame 10 stably stands on the ground, and the handle 20 is connected to the base 10. Each rotary member 30 is a bar with an end pivoted on the frame 10 for ration on a substantial horizontal plane. The pedals 40 are respectively pivoted on distal end of the rotary members 30 to respectively move in an inwards curved path L1 and L2 (the dot lines shown in FIG. 3).

The frame 10 is provided with stop members 10*a*, 10*b* to limit the rotation of the rotary members 30. Each path has a front end a1, a2, a rear end b1, b2, and a middle point c1, c2. A distance between the middle points c1 and c2 is shorter than a distance between the front ends a1 and a2, and is shorter than a distance between the rear ends b1 and b2 as well.

Figure 4:
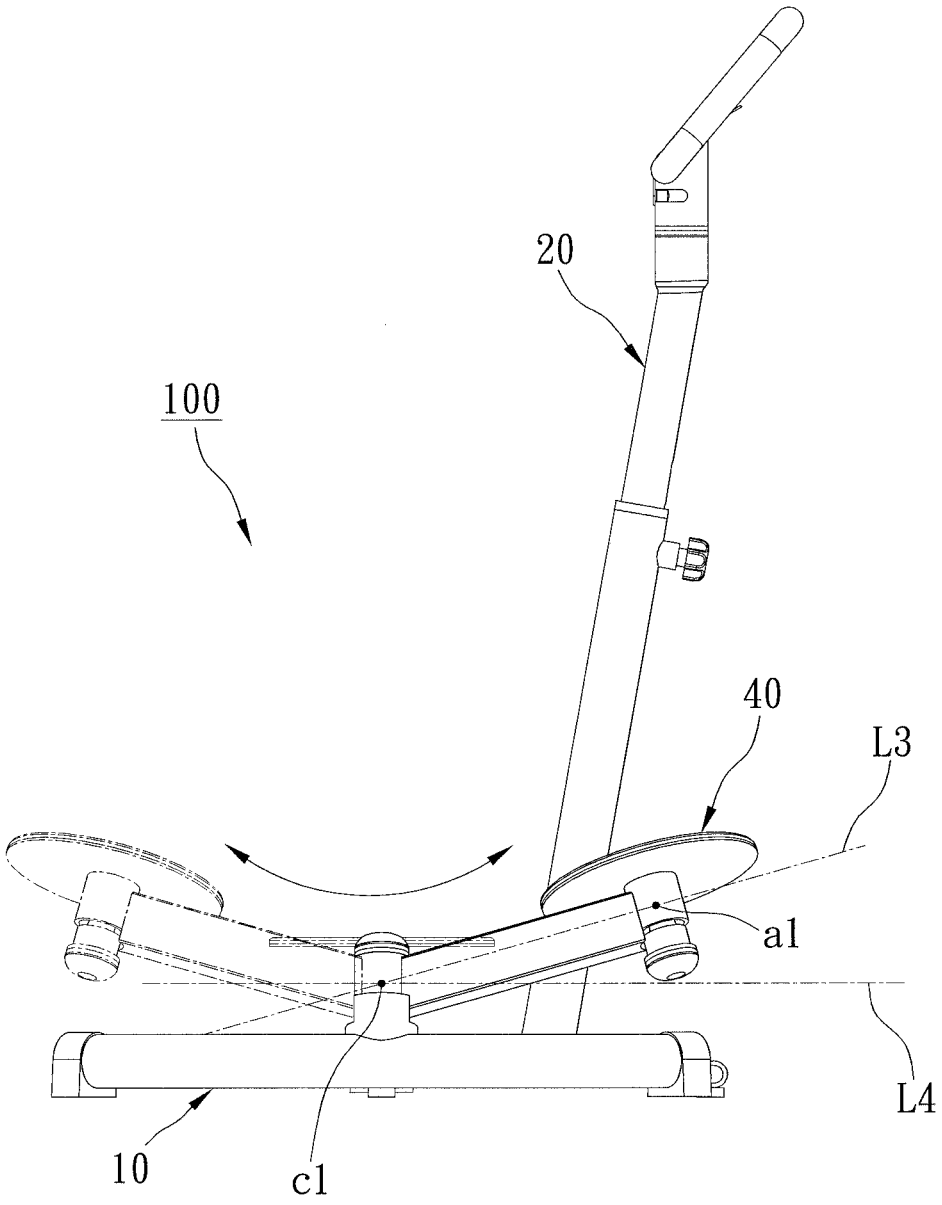
FIG. 4 is a front view of the training machine of the preferred embodiment of the present invention, showing the path of motion in the perpendicular plane.

As shown in FIG. 1 and FIG. 4, each rotary member 30 has an axle 31 pivoted on the frame 10, and the axles 31 slightly lean inwardly so that the front ends a1, a2 and the rear ends b1, b2 are higher than the middle points c1, c2. As shown FIG. 4, an included angle between a line L3 which passes the front end a1 and the middle point c1 and a horizontal line is in a range between 10 degrees and 20 degrees, and a preferable included angle is 15 degrees.

A user may take the sliding exercise on the training machine 100. First, the user stands on the pedals 40 and holds the handle 20 to be ready for the sliding exercise.

Figure 5:
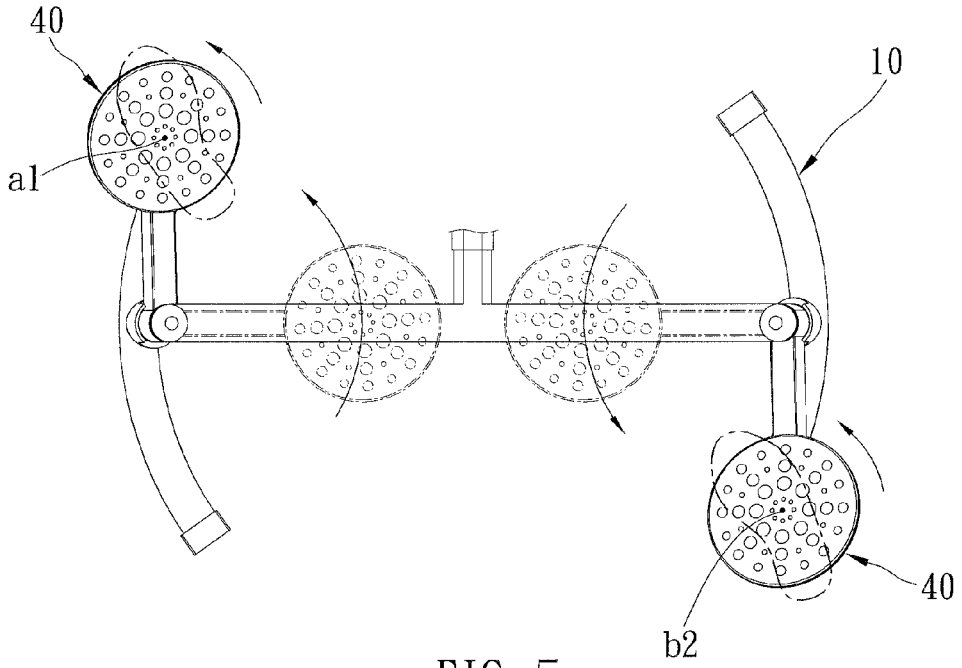
FIG. 5 and FIG. 6 are top views of the training machine of the preferred embodiment of the present invention, showing the feet moving in opposite directions.
Figure 6:
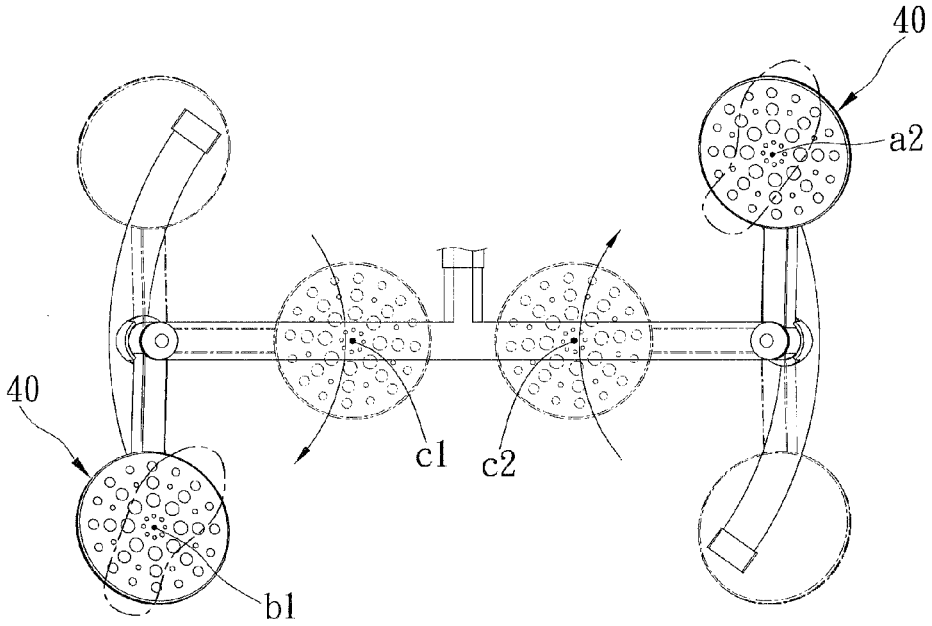

In the beginning, both the pedals 40 are at middle points c1 and c2, and then the use moves the feet in opposite directions, as shown in FIG. 5 and FIG. 6. FIG. 5 shows that the left foot moves forward and laterally to the front end a1, and meanwhile the right foot moves rearward and laterally to the rear end b2. Next, the left foot moves rearward and medially from the front end a1 to the middle point c1, and keeps moving rearward and laterally to the rear end b1. At the same time, the right foot moves forward and medially front the rear end b2, and keeps moving forward and laterally to the front end a2. The height difference (gravity) helps the feet to move from the front/rear end to the middle point. A distance between the feet is getting longer when the feet are respectively moving from the middle point to the front/rear end, and is getting shorter when the feet are respectively moving from the front/rear end to the middle point.

It is easy to understand that the feet repeatedly move forward/rearward and split during the sliding exercise. Besides, the pedals 40 are free for rotation so that the feet may rotate purposely or naturally during the sliding exercise. FIG. 5 and FIG. 6 show that both feet keep straight. The center of weight of the user keeps steady in the sliding exercise so that it will provide a safe exercise. During the sliding exercise, the user will twist his/her hip that will train another portion of body. The conventional exercise only makes the feet to move forward and rearward, and a distance between the feet in a left-right direction keeps the same. However, the sliding exercise of the present invention makes the feet to move in two substantial orthogonal directions on a horizontal plane, forward-rearward and lateral-medial.

Figure 7:
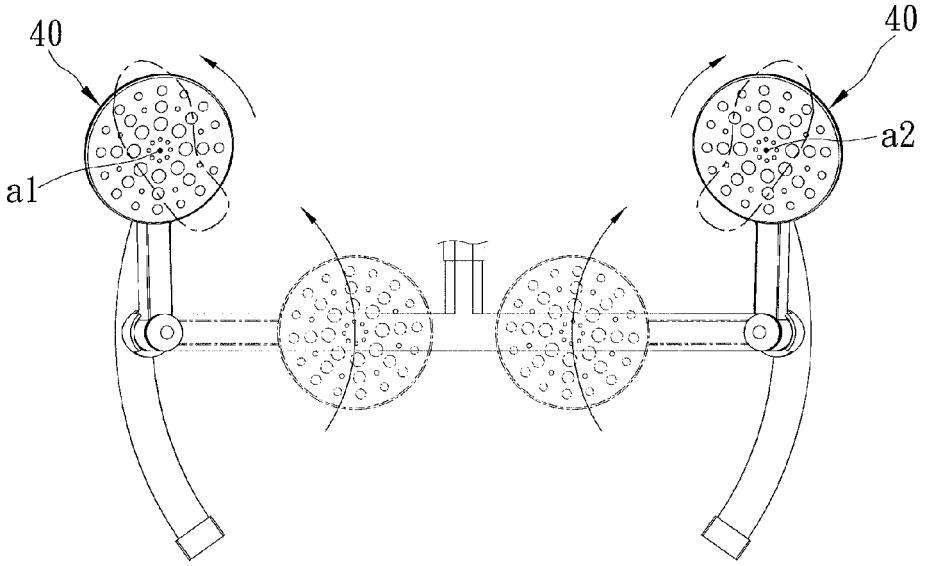
FIG. 7 and FIG. 8 are top views of the training machine of the preferred embodiment of the present invention, showing both the feet moving in the same direction.
Figure 8:
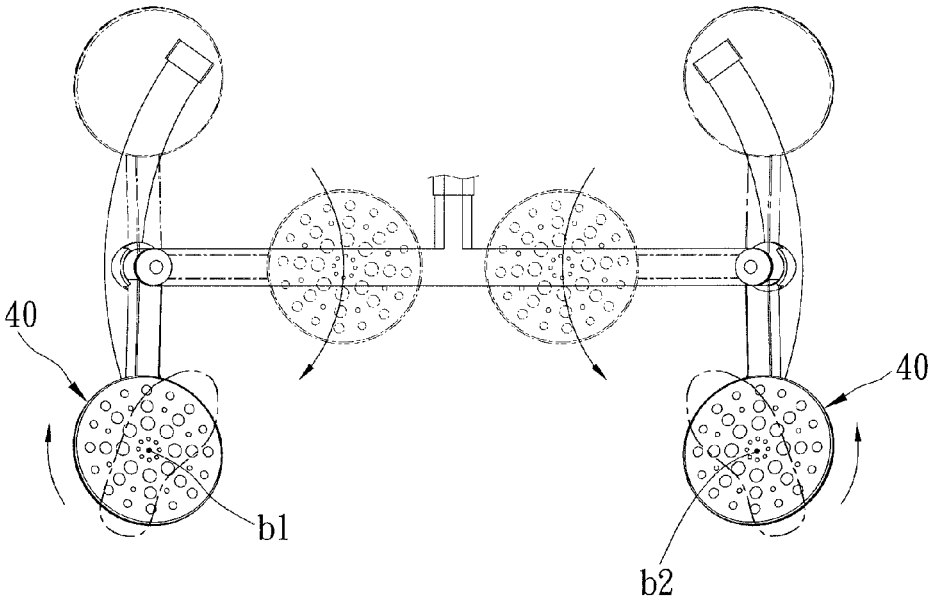

The sliding exercise of the present invention makes the feet to move in the curved paths on a substantial horizontal plane. Therefore, the feet may move in the same direction. In the second kind of the sliding exercise, the center of weight of the user will move during the exercise. As shown in FIG. 7 and FIG. 8, the user respectively moves both feet forward and laterally from the middle points c1, c2 to the front ends a1, a2, and then move both feet rearward to the rear ends b1, b2 through the middle points c1, c2. This kind of exercise trains trunk's muscles. But the user has to prevent the hip injuries from twisting. The feet will rotate during the sliding exercise. FIG. 7 shows that the feet rotate laterally at the front ends a1, a2, and the feet rotate medially at the rear ends b1, b2. The second kind of the sliding exercise may be taken on the training machine 100 also.

Figure 9:
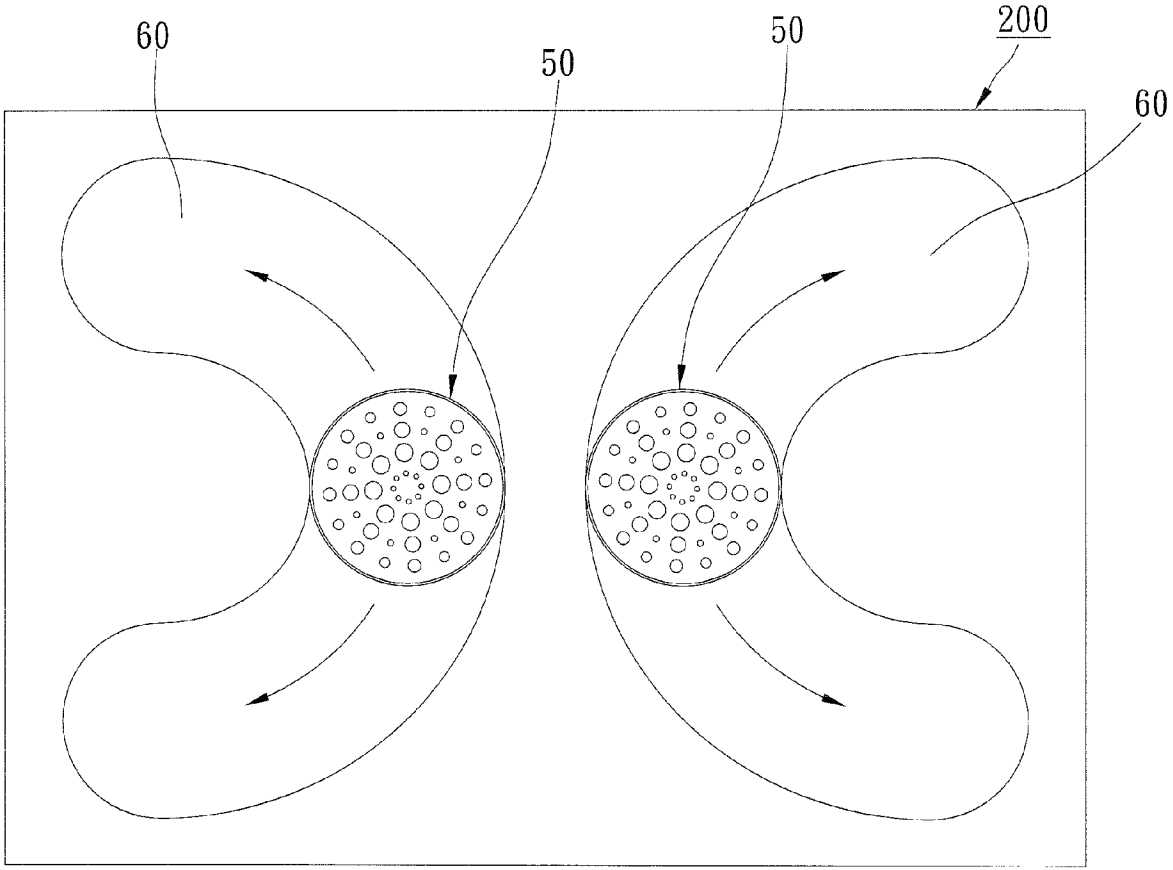
FIG. 9 is a top view of another training machine of the preferred embodiment of the present invention.

FIG. 9 shows another training machine 200 on which the user may take the sliding exercise. The training machine 200 provides two sliding slots 60, and the pedals 50 respectively engage the sliding slots 60 for sliding. The sliding slots 60 extend the same as the paths as described above.

The description above is a few preferred embodiments of the present invention, and the equivalence of the present invention is still in the scope of claim construction of the present invention.

What is claimed is:

1. A method of performing a sliding exercise, the method comprising the steps of:

a) providing a training machine comprising two pedals, wherein the training machine further has a frame and two rotary members, wherein each rotary member is a bar with an end pivoted on the frame, and the pedals are respectively pivoted on a distal end of each rotary member;

b) putting a user's feet on the pedals; and c) reciprocating the feet in opposite directions; wherein the feet respectively move in an inwards curved path on a substantial horizontal plane;

wherein the paths are symmetrical, and each of the paths is defined to have a front end, a rear end and a middle point; for each of the paths, the middle point is between the front end and the rear end, and a distance between the middle point and the front end equals the distance between the middle point and the rear end; a distance between the two middle points is shorter than a distance between the two front ends and a distance between the two rear ends so that the feet move forward and rearward and split when the feet respectively reciprocate between the front end and the rear end.

2. The method as defined in claim 1, wherein the front ends and the rear ends are higher than the middle points so that gravity helps the feet to move from the front end or the rear end to the middle point.

3. The method as defined in claim 2, wherein an included angle between a line which passes the front end and the middle point and the horizontal plane is in a range between 10 degrees and 20 degrees.

4. The method as defined in claim 3, wherein the training machine includes a handle; and further comprising the step of holding the handle during the sliding exercise.

5. The method as defined in claim 3, further comprising the step of twisting hip while the feet are reciprocating in the opposite directions.

6. The method as defined in claim 1, wherein the pedals are free to rotate so that the feet keep straight during the sliding exercise.

7. The method as defined in claim 1, wherein each of the rotary members is pivoted on the frame with an axle thereof; the axles lean inwardly so that the pedals are at a higher position when they are at the front ends or the rear ends than they are at the middle points.

8. A method of performing a sliding exercise, the method comprising the steps of:

a) providing a training machine comprising two pedals, wherein the training machine further has a frame and two rotary members, wherein each rotary member is a bar with an end pivoted on the frame, and the pedals are respectively pivoted on a distal end of each rotary member;

b) putting a user's feet on the pedals; and c) reciprocating the feet in the same direction; wherein the feet respectively move in an inwards curved path on a substantial horizontal plane;

wherein the paths are symmetrical, and each of the paths is defined to have a front end, a rear end and a middle point; for each of the paths, the middle point is between the front end and the rear end, and a distance between the middle point and the front end equals the distance between the middle point and the rear end; a distance between the two middle points is shorter than a distance between the two front ends and a distance between the two rear ends so that the feet move forward and rearward and split when the feet respectively reciprocate between the front end and the rear end.

9. The method as defined in claim 8, wherein the front ends and the rear ends are higher than the middle points so that gravity helps the feet to move from the front end or the rear end to the middle point.

10. The method as defined in claim 9, wherein an included angle between a line which passes the front end and the middle point and the horizontal plane is in a range between 10 degrees and 20 degrees.

11. The method as defined in claim 8, wherein the pedals are free to rotate so that the feet are able to rotate during the sliding exercise.

12. The method as defined in claim 8, wherein the training machine includes a handle; and further comprising the step of holding the handle during the sliding exercise.

13. The method as defined in claim 8, wherein each of the rotary members is pivoted on the frame with an axle thereof; the axles lean inwardly so that the pedals are at a higher position when they are at the front ends or the rear ends than they are at the middle points.

* * * * *